US006212825B1

(12) United States Patent
Hopkins, Jr.

(10) Patent No.: US 6,212,825 B1
(45) Date of Patent: Apr. 10, 2001

(54) SAFETY CROSSING GATE

(75) Inventor: George F. Hopkins, Jr., Revelstoke (CA)

(73) Assignee: Sentinel Innovative Technologies Incorporated, Revelstoke (CA)

( * ) Notice: Subject to any disclaimer, the term of this patent is extended or adjusted under 35 U.S.C. 154(b) by 0 days.

(21) Appl. No.: 09/604,809

(22) Filed: Jun. 28, 2000

Related U.S. Application Data

(60) Provisional application No. 60/140,996, filed on Jun. 29, 1999.

(51) Int. Cl.[7] ..... E01F 3/68

(52) U.S. Cl. ..... 49/49; 49/358; 49/29

(58) Field of Search ..... 49/49, 34, 9, 29, 49/30, 358; 404/6, 9, 10

(56) References Cited

U.S. PATENT DOCUMENTS

| | | | | |
|---|---|---|---|---|
| 1,536,360 | | 5/1925 | Stewart . | |
| 1,899,496 | | 2/1933 | Day . | |
| 2,874,493 | | 2/1959 | Mandel . | |
| 3,994,457 | | 11/1976 | Teasel . | |
| 4,364,200 | * | 12/1982 | Cobb | 49/49 X |
| 4,531,325 | * | 7/1985 | Phillips | 49/49 |
| 4,655,002 | * | 4/1987 | Everson | 49/49 X |
| 4,666,108 | | 5/1987 | Fox . | |
| 4,897,960 | | 2/1990 | Barvinek et al. . | |
| 5,429,329 | | 7/1995 | Wallace et al. . | |
| 5,442,878 | * | 8/1995 | Flores | 49/49 X |
| 5,469,660 | | 11/1995 | Tamenne . | |
| 5,671,563 | * | 9/1997 | Marcum | 49/49 |
| 5,699,986 | | 12/1997 | Welk . | |
| 5,884,432 | | 3/1999 | DeLillo . | |

FOREIGN PATENT DOCUMENTS

| | | |
|---|---|---|
| 1272280 | 7/1990 | (CA) . |

* cited by examiner

*Primary Examiner*—Jerry Redman
(74) *Attorney, Agent, or Firm*—Antony C. Edwards

(57) ABSTRACT

The safety crossing gate for a railway crossing of the present invention includes a secondary gate rotatably mounted or mountable to a primary crossing gate. The secondary gate is a rigid elongated member having first and second opposite ends. The second end of the secondary gate is rotatably mounted or mountable to a free end of the primary crossing gate by a rotatable coupling mounted or mountable to the second end of secondary gate and the free end of the primary crossing gate so as to allow selectively actuable rotation of the first end of the secondary gate relative to the primary crossing gate in a generally vertical plane containing the primary crossing gate when the secondary gate is rotatably mounted to the primary crossing gate by the rotatable coupling.

22 Claims, 2 Drawing Sheets

28
24
22
A
44
26a
10''
16
26
C
30
B
20
10'
D
42
F
12
C
40
32
10
34
38

E
14
D 42
16
12
10
40

SAFETY CROSSING GATE

CROSS REFERENCE TO RELATED APPLICATION

This application claims priority from U.S. Provisional Patent Application No. 60/140,996 filed Jun. 29, 1999 titled Safety Crossing Gate.

FIELD OF THE INVENTION

This invention relates to the field of gates for highway-rail grade crossings and in particular to a gate which deploys a secondary arm as, or after, a primary gate arm is lowered so as to cover both lanes of a highway crossing a railway grade.

BACKGROUND OF THE INVENTION

A highway-rail grade crossing presents a unique and potentially dangerous traffic obstacle for inexperienced motorists. The fact is that many drivers do not cross railroad tracks often enough to be familiar with the warning devices including safety gates which are there for their own safety. Such drivers are often unaware that trains cannot stop nearly as quickly as motor vehicles in order to avoid a collision. Other drivers for whatever reason, including impatience, simply ignore all warning signs and attempt to defeat railroad crossing warning devices in order to cross over before a train arrives. Combined, driver inattention and impatience are the most common factors contributing to collisions between motor vehicles and trains at highway-rail grade crossings according to Operation Lifesaver, a non-profit public education program having the object of eliminating collisions, deaths and injuries at highway-rail intersections and on railroad rights of way.

Operation Lifesaver reports that thousands of people are seriously injured and hundreds are killed in about 4,000 highway-rail grade crossing crashes each year involving collisions between motor vehicles and trains. Also according to Operation Lifesaver, this translates into a collision between a person or a vehicle and a train approximately every 100 minutes in the United States, thus making it 40 times more likely that a motorist will die in a collision with a train than a collision with another motor vehicle. It is important to keep in mind that, again according to Operation Lifesaver, there are approximately 270,000 highway-rail grade crossings in the United States and that over 50% of crashes at public grade crossings occur where active warning devices such as gates, lights and/or bells exist. In 1996, collisions at public highway-rail crossings between trains and automobiles accounted for approximately 40 percent of all forms of collisions with trains at such crossings.

Many railroad public crossings at grade, specifically highway crossings used by automobiles, have protection gates that are actuated automatically by an approaching train. The gates rotate down into a horizontal position from a vertical position to prevent vehicles from entering onto the tracks as the train approaches and passes by. In many instances these gates only span across half the roadway, usually a single lane. Thus one-half of the roadway is left open. Vehicles often will, rather than wait for an approaching train to pass, go around the lowered gate and proceed into the path of the approaching train if the driver of the vehicle thinks he or she can get over the crossing before the train arrives.

When applicant inquired of those who maintain these gates as to the reason for the gates only spanning half the roadway, he was informed that in a situation where a vehicle arrives at the crossing to find the gates moving down and successfully goes under the gate in that vehicles lane, the vehicle may then still proceed straight ahead to clear the crossing without being immediately blocked on the other side of the track by a lowered gate intended to prevent traffic crossing from the opposite direction.

Consequently, it is an object of the present invention to provide a secondary section of gate of sufficient length to span the half of the roadway not blocked by a primary gate, the secondary gate rotatably mounted at the tip or free end of the primary gate and rotatable 180 degrees into a lowered position by means of a small motor and gearbox.

In the prior art, Applicant is aware of the following United States patents which deal with improvements to single arm railway crossing gates so as to deal with the problem of vehicles striking the gates, none of which teach the use of a secondary gate extension: U.S. Pat. No. 2,874,493 which issued Feb. 24, 1959 to Mandel for an Automatic Signal and Barrier Device for Railroad Crossings, U.S. Pat. No. 3,994,457 which issued Nov. 30, 1976 to Teasel for a Crossing Gate, U.S. Pat. No. 5,469,660 which issued Nov. 28, 1995 to Tamenne for a Self-Restoring Railroad Highway Crossing Gate Device, and U.S. Pat. No. 5,884,432 which issued Mar. 23, 1999 to DeLillo for a Breakaway Assembly for Vehicle Barrier Device.

Applicant is also aware of U.S. Pat. No. 4,666,108 which issued on May 19, 1987 to Fox for an Extensible Railroad Grade Crossing Gate Arm and U.S. Pat. No. 5,671,563 which issued Sep. 30, 1997 to Marcum for a Vehicle Control Arm Device. Both Marcum and Fox disclose the use of a secondary gate arm extension, Marcum providing a breakaway end section addressing the problem of the gate being struck and damaged by vehicles, Fox disclosing a telescoping second arm member telescopically inserted in a first arm member. Neither Fox nor Marcum teach nor suggest the advantages of the present invention as set out herein.

SUMMARY OF THE INVENTION

Consequently, it is an object of the present invention to provide a secondary section of gate of sufficient length to span the half of the roadway not blocked by a primary gate, the secondary gate rotatably mounted at the tip or free end of the primary gate and rotatable 180 degrees over the primary gate into a lowered position by means of a small motor and gearbox. Rotating the secondary gate in a generally vertical plane over the primary gate provides oncoming car traffic with a large, moving and highly visible cue that the approach of the train is imminent.

When not actuated the secondary section of gate would normally be in a retracted position beside or on top of the primary gate. The secondary section of gate is rotated into an extended position after the primary gate is rotated down, so as to approach, its fully lowered position. The lowering of the secondary gate is timed to include enough delay so that a vehicle which drives under a primary gate on one side of a crossing as the primary gate is lowering would have sufficient time to proceed across the crossing and under the secondary gate section on the other side before the secondary section on the other side is rotated into its horizontal, extended position. The timing of the delay is adjusted to allow time for a vehicle to clear, depending on the size, i.e. number of tracks across the crossing. Prior art sensors, known to one skilled in the art, may be employed to detect a vehicle's presence in the crossing to help coordinate the delay. Secondary gate sections thus effectively block vehicles from going around the tip or free end of the primary gate and into the path of an oncoming train during the critical seconds before a collision would be inevitable.

In one embodiment, not intended to be limiting, the secondary gate section is fitted with a double acting spring-type hinge, advantageously near the end mounted to the tip of the primary gate. The hinge allows the secondary gate to be pushed aside by a vehicle in circumstances which would otherwise result in a collision. The spring then urges the secondary gate back into position. Alternatively the secondary gate may be rigid, and it may be mounted to the primary gate in a similar manner to how the primary gate is now mounted to the gate actuating mechanism, for example a Safetran™ Model S-40 gate actuating mechanism, so as to break away when ran into by a vehicle.

The secondary gate section may be of the same type of material (for example, wood, aluminum or fiberglass) as the primary gate, have the same dimensions (although length may vary) and have lights mounted in the same manner as the primary gate.

The rotation assembly for rotation actuation of the secondary gate may be a small motor and gearbox which is capable of rotating a drive shaft 180 degrees. Rotation of the shaft is controlled by relays and limit switches. The motor and gearbox may be mounted at the free end of the primary gate. Materials needed for installation and actuation of the secondary gate section are readily available commercially. The materials include rotation motor/gearboxes, relays, timers, mounting brackets, bearings, limit switches, circuit breakers, wiring, as would be known to one skilled in the art.

In summary, the safety crossing gate for a railway crossing of the present invention includes a secondary gate rotatably mounted or mountable to a primary crossing gate. The secondary gate may be mounted on either side, i.e. either in front of, or behind, the primary crossing gate. The secondary gate is a rigid elongated member having first and second opposite ends. The second end of the secondary gate is rotatably mounted or mountable to a free end of the primary crossing gate by a rotatable coupling mounted or mountable to the second end of secondary gate and the free end of the primary crossing gate so as to allow selectively actuable rotation of the first end of the secondary gate relative to the primary crossing gate in a generally vertical plane containing the primary crossing gate when the secondary gate is rotatably mounted to the primary crossing gate by the rotatable coupling.

A selectively operable actuator is mounted or mountable to the secondary gate and the primary gate for selectively actuable rotation of the secondary gate relative to, and only above, the primary crossing gate about the rotatable coupling when the secondary gate is mounted to the primary crossing gate and the primary crossing gate is rotatably mounted to a gate actuating mechanism housing. The secondary gate is rotatable only above the primary crossing gate in the vertical plane between an extended position extending from and generally parallel to the primary crossing gate and retracted position rotated upwardly at least substantially 90 degrees from the extended position.

The secondary gate is rotatable only above said primary crossing gate so as to allow delayed actuation of the secondary gate after deployment of the primary crossing gate into a horizontal position blocking a first lane of a roadway entering the railway crossing. The delayed actuation allows vehicles to escape from the railway crossing after the deployment of the primary crossing but before the delayed actuation of the secondary gate into the extended position. The extended position of the secondary gate blocks a second lane of the roadway adjacent the first lane.

The rotatable coupling may be a shaft mounted or mountable, so as to extend between, the second end and the free end. The actuator may be an electric motor mounted or mountable to the shaft. The motor may also be mounted or mountable to the free end of the primary crossing gate. A distal end of the shaft is journalled through an aperture in the free end of the primary crossing gate and is rigidly mounted or mountable to the second end of the secondary gate. The shaft is freely rotatable in the aperture in the free end of the primary crossing gate.

In one embodiment the second end and the free end are hollow and have open ends. In this embodiment first and second rigid inserts are snugly and slidably mounted or mountable so as to be journalled into the open ends of the second end and the free end respectively. In this embodiment the rotatable coupling may be a shaft mounted or mountable, so as to extend between, the first and second inserts. If the actuator is an electric motor, it may be mounted or mountable to the shaft and to the second insert. A distal end of the shaft is journalled through an aperture in the second insert and is rigidly mounted or mountable to the first insert. The shaft is freely rotatable in the aperture in the second insert.

The delayed actuation of the secondary gate into the extended position by the actuator may be time delayed by an electronic time delay means, for example a time delayed electrical actuation signal to the motor, so as to allow time for a vehicle to depart from a danger zone in the railway crossing and pass by the secondary gate before the secondary gate is fully deployed into the extended position. The retraction of the secondary gate may commence once the train enters the crossing so that the secondary gate is retracting as the train is passing by. Once the train has passed through the crossing entirely, the primary gate may be raised in the usual fashion. In this manner, the secondary gate does not add to the delay experienced by waiting car traffic.

DETAILED DESCRIPTION OF PREFERRED EMBODIMENTS

Figure 1:
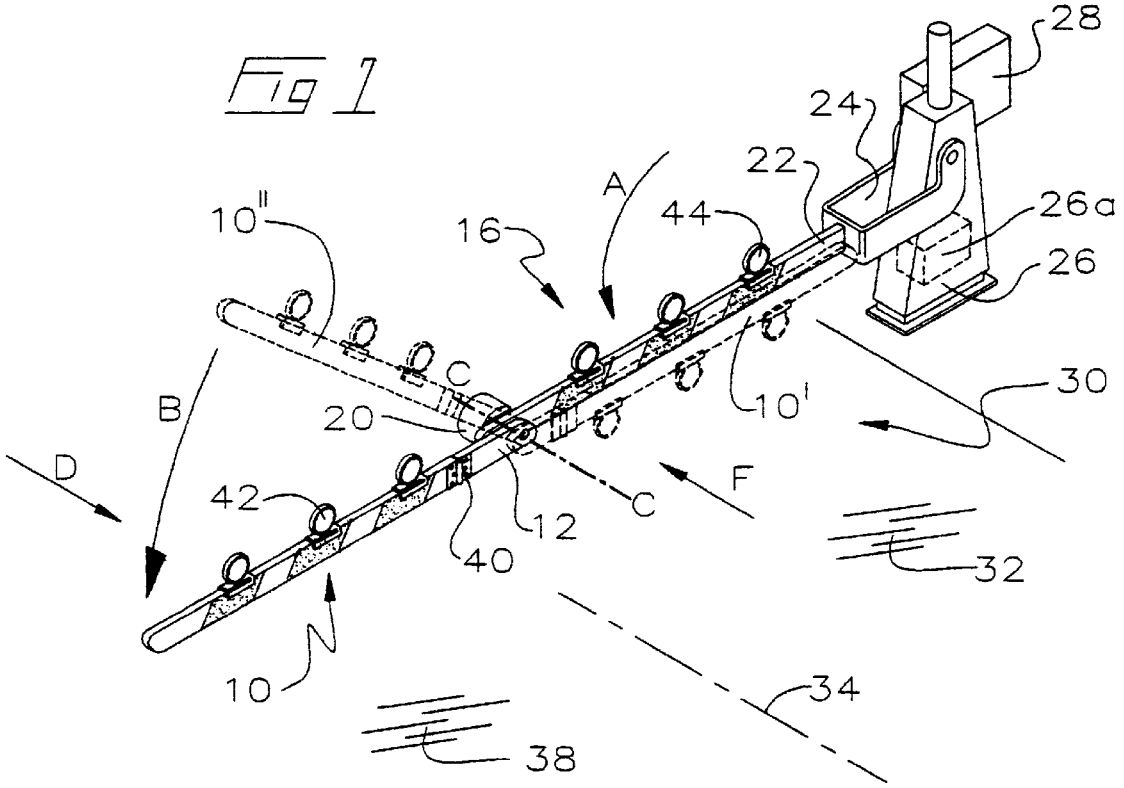
FIG. 1 is, in perspective view, a conventional railway crossing gate having a secondary gate according to the present invention mounted thereon.
Figure 2:
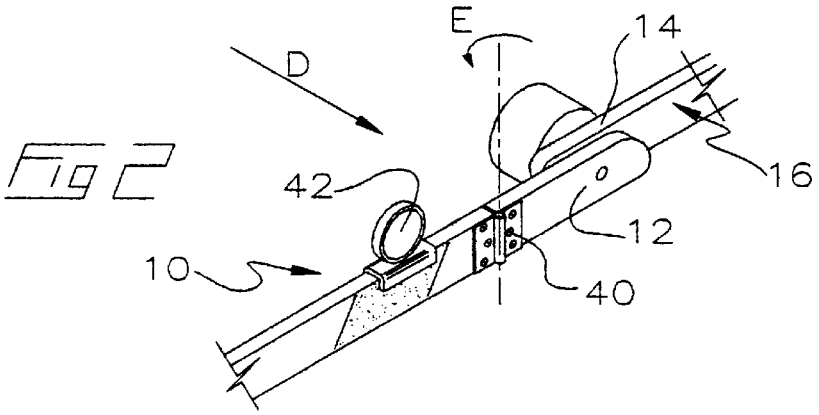
FIG. 2 is a partially cut-away enlarged view taken from FIG. 1.
Figure 3:
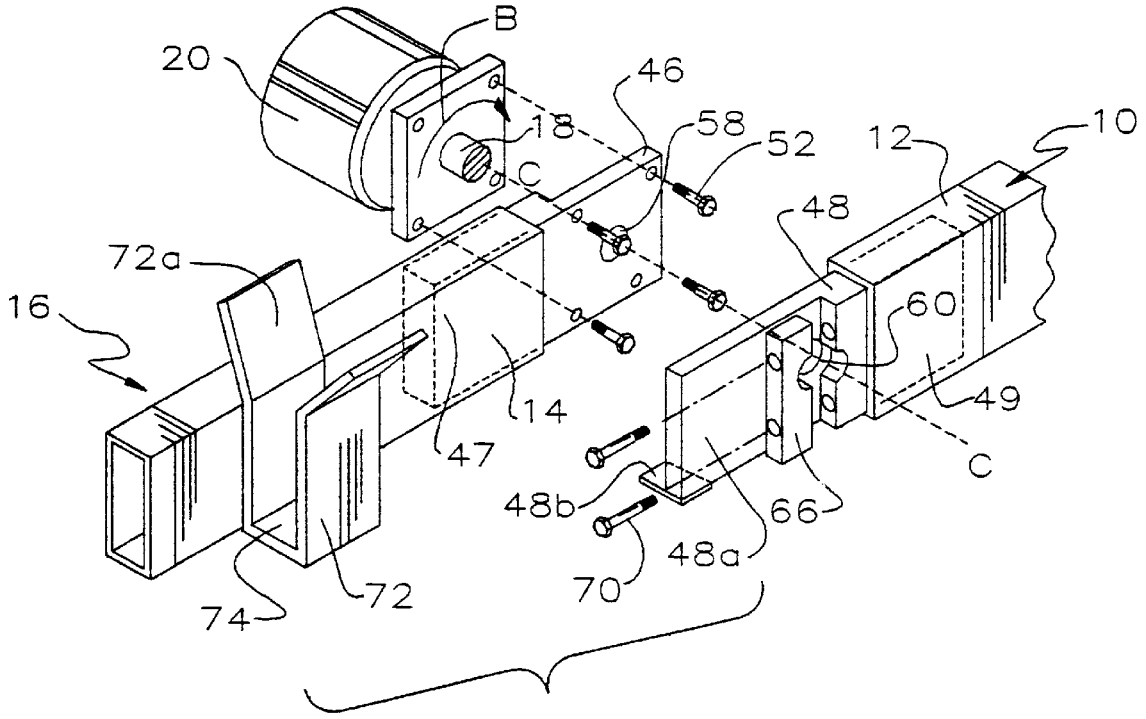
FIG. 3 is an exploded view of the rotation motor secondary gate actuator assembly.

As illustrated in FIGS. 1–3, a secondary gate 10 according to one embodiment of the present invention is rotatably mounted at its base end 12 to the free end 14 of primary gate 16. Base end 12 is mounted, for example by means of drive shaft 18 to rotation motor 20 as better described below.

Primary gate 16 is rigidly mounted at its base end 22 to support arm 24. Support arm 24 is pivotally mounted to gate actuating mechanism housing 26 and may support counter weight 28 on the side of gate actuating mechanism housing 26 opposite to primary gate 16. Gate actuating mechanism housing 26 is bolted to a concrete foundation buried in the ground or shoulder beside roadway 30.

With the approach of a train, gate actuating mechanism housing 26 is automatically triggered so as to rotate primary gate 16 downwardly from a vertical position (not shown) in direction A into a horizontal position so as to block an incoming traffic lane 32, that is, so that primary gate 16 extends across lane 32 so as to place free end 14 generally above or extended slightly beyond roadway center line 34.

The electronic control that instigates downward rotation of primary gate 16 in direction A will also actuate rotation motor 20. The electronic control includes a timer 26*a* (shown diagrammatically in dotted outline). It is mounted in the gate actuating mechanism housing 26. The electronic control is electrically connected to motor 20. Depending on the desired time delay, secondary gate 10 is rotated in direction B relative to primary gate 16 either as primary 16 is being lowered in direction A or after primary gate 16 has been lowered into its horizontal resting position. Secondary gate 10 when in its stowed or retracted position lies adjacent to, and parallel with, primary gate 16. In FIG. 1, secondary gate 10 is shown in its retracted position in dotted outline and indicated by reference numeral 10'. Secondary gate 10 is deployed by rotation about axis C—C in direction B so as to pass through intermediate positions as indicated by reference numerals 10". The object of introducing a delay in deploying secondary gate 10 relative to the deployment of primary gate 16, is to allow time for a vehicle coming in the opposite direction, namely direction D, which has passed under a primary gate on the opposite side of the railway crossing, to exit the railway crossing danger area 36 along outgoing traffic lane 38 unimpeded by the lowering of the secondary gate 10. This avoids trapping a vehicle between primary and secondary crossing gates which have been simultaneously lowered on either side of area 36.

In the event that a vehicle stalls while in area 36, and consequently both primary and secondary gates are lowered in front of and behind the vehicle, in order to avoid a collision with an oncoming train, the vehicle has no choice but to drive through the barricade. This dangerous and foreseeable situation is provided for in the present invention by either the use of conventional shear pins at the base end of one or both gate sections and/or, as better seen in FIG. 2, by incorporation of springloaded hinge 40 in base end 12 of the secondary gate 10. Hinge 40 allows for a vehicle striking secondary gate 10 in direction D to swing the secondary gate away from the vehicle in direction E as better seen in FIG. 2. Secondary gate 10 may thus fold about hinge 40 out of the path of a vehicle passing in direction D thereby allowing the vehicle to escape from area 36.

In an alternative embodiment, hinge 40 is a double acting hinge allowing secondary gate 10 to fold, not only in direction E out of collinearity with base end 12, but also in a direction opposite to direction out of collinearity with base end 12. In this embodiment, a double acting hinge 40 allows a vehicle which has approached primary gate 16 in direction F along incoming traffic lane 32 to fold back secondary gate 10 about hinge 40 in the event that the vehicle decides to try and beat secondary gate 10 as it is rotating in direction B and is unsuccessful so as to strike secondary gate 10. In either embodiment, whether hinge 40 is a single acting hinge or a double acting hinge, hinge 40 is of a known design which provides a return biasing force so as to return the free end of secondary gate 10 into its collinear position collinear with base end 12.

In the preferred embodiment, secondary gate 10 is provided with signal lamps 42. Signal lamps 42 may be electrically connected in the electrical circuit for signal lamps 44 on primary gate 16 by means of wiring conduit (not known) passing along primary gate 16, and secondary gate 10. Thus as signal lamps 44 flash or are otherwise illuminated, so too are signal lamps 42.

As better seen in the exploded view of FIG. 3, rotation motor 20, which may be a small electrical motor and/or gearbox as would be known to one skilled in the art, is mounted to free end 14 on primary gate 16. Specifically, the embodiment of FIG. 3 is directed to a retrofit of the present invention where primary gate 16 is a conventional hollow aluminum beam such as often presently used and supplied commercially by Safetran™. In the retrofit embodiment of the present invention, it is convenient to also use a hollow aluminum beam as the secondary gate 10 so that the same supply of aluminum beam sections used for the primary gate may also be used for the secondary gate. Alternatively, secondary gate 10 may be a hollow fiberglass beam.

Because the aluminum or fiberglass beams are hollow, it is convenient to use inserts such as primary insert 46 and secondary insert 48 which may be machined or formed of metal or perhaps wood or perhaps plastic or the like. Inserts 46 and 48 have corresponding tangs 47 and 49 respectively as shown in dotted outline in FIG. 3. The tangs are snugly journalled into the respective primary and secondary gates by sliding the tangs into the hollow openings at free end 14 and base end 12 respectively. Inserts 46 and 48 may be notched as illustrated and would be secured within the ends of the gates by appropriate methods known in the art such as by bolting, welding or the like. Insert 48 may also be lengthened at end 48*a*, that is, at the end opposite to tang 49. Such lengthening provides an attachment point for counterweights to offset the weight of secondary gate 10 as needed. Further, insert 48 may also have a rigid tab 48*b* mounted on the side facing rotation motor 20 which will act to limit the travel of secondary gate 10 to not more than a horizontal position when in its deployed position.

Insert 46 provides a rigid mounting platform to which rotation motor 20 may be bolted by means of bolts 52. Rotation motor 20 is bolted onto insert 46 so as to journal the rotation motors output shaft 18 through corresponding bore holes 58 and 60 in inserts 46 and 48 respectively.

Output shaft 18 is long enough to extend through insert 46 through bore hole 58, and through bore hole 60 so as to extend, once assembled, from the side of insert 48 opposite rotation motor 20. Output shaft 18 is rigidly mounted to insert 48, for example, by means of split collar 66. Split collar 66 is rigidly mounted to insert 48, for example, by means of bolts 70.

Thus, actuation of rotation motor 20, rotates drive shaft 18, for example, in direction B about axis C—C so as to deploy secondary gate 10 from its stowed position adjacent primary gate 16.

In one preferred embodiment, self centering rests 72 are mounted along primary gate 16. Self centering rest 72 have upwardly opening flared flanges 72*a* so as to capture therebetween secondary gate 10 as secondary gate 10 is rotated in a direction opposite to direction B from its deployed position into its stowed position resting within channel cavity 74 in self centering rests 72. Rubber stops (not shown) or the like may be provided within self-centering rests 72 or along the corresponding side of primary gate 16 so as to provide a spacer between the two gate sections and also to provide for dampening of any oscillatory motion of secondary gate 10 which otherwise might cause impact which may eventually damage secondary gate 10. Rotation motor 20 may be electrically powered by means of electrical wiring (not shown) running along and within the hollow aluminum beam of primary gate 16. Limit switches or sensors (not shown) may also be employed to disengage rotation motor 20 when secondary gate 10 is fully deployed or fully stowed.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A safety crossing gate for a railway crossing comprising:

a secondary gate rotatably mountable to a primary crossing gate, wherein said secondary gate is a rigid elongated member having first and second opposite ends, wherein said second end of said secondary gate is rotatably mountable to a free end of said primary crossing gate by a rotatable coupling mountable to said second end of secondary gate and said free end of said primary crossing gate so as to allow selectively actuable rotation of said first end of said secondary gate relative to said primary crossing gate in a generally vertical plane containing said primary crossing gate when said secondary gate is rotatably mounted to said primary crossing gate by said rotatable coupling, a selectively operable actuator mountable to said secondary gate and said primary gate for selectively actuable rotation of said secondary gate relative to, and only above, said primary crossing gate about said rotatable coupling when said secondary gate is mounted to said primary crossing gate and said primary crossing gate is rotatably mounted to a gate actuating mechanism housing, said secondary gate rotatable only above said primary crossing gate in said vertical plane between an extended position extending from and generally parallel to said primary crossing gate and retracted position rotated upwardly at least substantially 90 degrees from said extended position, said secondary gate rotatable only above said primary crossing gate so as to allow delayed actuation of said secondary gate after deployment of said primary crossing gate into a horizontal position blocking a first lane of a roadway entering said railway crossing, wherein said delayed actuation allows vehicles to escape from said railway crossing after said deployment of said primary crossing but before said delayed actuation of said secondary gate into said extended position, said extended position blocking a second lane of said roadway adjacent said first lane.

2. The device of claim 1 wherein said rotatable coupling is a shaft mountable, so as to extend between, said second end and said free end.

3. The device of claim 2 wherein said actuator is an electric motor mountable to said shaft.

4. The device of claim 3 wherein said motor is mountable to said free end of said primary crossing gate, and wherein a distal end of said shaft is journalled through an aperture in said free end and is rigidly mountable to said second end of said secondary gate, said shaft freely rotatable in said aperture in said free end.

5. The device of claim 3 wherein said delayed actuation of said secondary gate into said extended position by said actuator is time delayed by a time delayed electrical actuation signal to said motor.

6. The device of claim 1 wherein said second end and said free end are hollow and have open ends, said safety crossing gate further comprising first and second rigid inserts snugly and slidably mountable journalled into said open ends of said second end and said free end respectively.

7. The device of claim 6 wherein said rotatable coupling is a shaft mountable, so as to extend between, said first and second inserts.

8. The device of claim 7 wherein said actuator is an electric motor mountable to said shaft.

9. The device of claim 8 wherein said motor is mountable to said second insert when mounted in said free end of said primary crossing gate, and wherein a distal end of said shaft is journalled through an aperture in said second insert and is rigidly mountable to said first insert, said shaft freely rotatable in said aperture in said second insert.

10. The device of claim 8 wherein said delayed actuation of said secondary gate into said extended position by said actuator is time delayed by a time delayed electrical actuation signal to said motor.

11. The device of claim 1 wherein said delayed actuation of said secondary gate into said extended position by said actuator is time delayed by electronic time delay means so as to allow time for a vehicle to depart from a danger zone in said railway crossing and pass by said secondary gate before said secondary gate is fully deployed into said extended position.

12. A safety crossing gate for a railway crossing comprising:

a secondary gate rotatably mounted to a primary crossing gate, wherein said secondary gate is a rigid elongated member having first and second opposite ends, wherein said second end of said secondary gate is rotatably mounted to a free end of said primary crossing gate by a rotatable coupling mounted to said second end of secondary gate and said free end of said primary crossing gate so as to allow selectively actuable rotation of said first end of said secondary gate relative to said primary crossing gate in a generally vertical plane containing said primary crossing gate, a selectively operable actuator mounted to said secondary gate and said primary gate for selectively actuable rotation of said secondary gate relative to, and only above, said primary crossing gate about said rotatable coupling when said primary crossing gate and said primary crossing gate is rotatably mounted to a gate actuating mechanism housing, said secondary gate rotatable only above said primary crossing gate in said vertical plane between an extended position extending from and generally parallel to said primary crossing gate and retracted position rotated upwardly at least substantially 90 degrees from said extended position, said secondary gate rotatable only above said primary crossing gate so as to allow delayed actuation of said secondary gate after deployment of said primary crossing gate into a horizontal position blocking a first lane of a roadway entering said railway crossing, wherein said delayed actuation allows vehicles to escape from said railway crossing after said deployment of said primary crossing but before said delayed actuation of said secondary gate into said extended position, said extended position for blocking a second lane of said roadway adjacent said first lane.

13. The device of claim 12 wherein said rotatable coupling is a shaft mounted, so as to extend between, said second end and said free end.

14. The device of claim 13 wherein said actuator is an electric motor mounted to said shaft.

15. The device of claim 14 wherein said motor is mounted to said free end of said primary crossing gate, and wherein a distal end of said shaft is journalled through an aperture in said free end and is rigidly mounted to said second end of said secondary gate, said shaft freely rotatable in said aperture in said free end.

16. The device of claim 14 wherein said delayed actuation of said secondary gate into said extended position by said actuator is time delayed by a time delayed electrical actuation signal to said motor.

17. The device of claim 12 wherein said second end and said free end are hollow and have open ends, said safety crossing gate further comprising first and second rigid inserts snugly and slidably mounted journalled into said open ends of said second end and said free end respectively.

18. The device of claim 17 wherein said rotatable coupling is a shaft mounted, so as to extend between, said first and second inserts.

19. The device of claim 18 wherein said actuator is an electric motor mounted to said shaft.

20. The device of claim 19 wherein said motor is mounted to said second insert and wherein a distal end of said shaft is journalled through an aperture in said second insert and is rigidly mounted to said first insert, said shaft freely rotatable in said aperture in said second insert.

21. The device of claim 19 wherein said delayed actuation of said secondary gate into said extended position by said actuator is time delayed by a time delayed electrical actuation signal to said motor.

22. The device of claim 12 wherein said delayed actuation of said secondary gate into said extended position by said actuator is time delayed by electronic time delay means so as to allow time for a vehicle to depart from a danger zone in said railway crossing and pass by said secondary gate before said secondary gate is fully deployed into said extended position.

* * * * *